US008059381B2

(12) United States Patent
Maraval

(10) Patent No.: US 8,059,381 B2
(45) **Date of Patent: *Nov. 15, 2011**

(54) METHOD AND APPARATUS FOR CONTROLLING A LIFTING MAGNET OF A MATERIALS HANDLING MACHINE

(75) Inventor: Jean Maraval, Columbia, SC (US)

(73) Assignee: The Electric Controller & Manufacturing Company, LLC, St. Matthews, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/756,490

(22) Filed: Apr. 8, 2010

(65) Prior Publication Data

US 2010/0208407 A1 Aug. 19, 2010

Related U.S. Application Data

(63) Continuation of application No. 11/757,304, filed on Jun. 1, 2007, now Pat. No. 7,697,253.

(51) Int. Cl.
*H01H 47/00* (2006.01)

(52) U.S. Cl. ..... 361/144

(58) Field of Classification Search ..... 361/143, 361/144

See application file for complete search history.

(56) References Cited

U.S. PATENT DOCUMENTS

| | | | | |
|---|---|---|---|---|
| 3,445,105 | A | 5/1969 | Marcher | |
| 3,708,685 | A * | 1/1973 | Miller et al. | 307/104 |
| 3,859,571 | A * | 1/1975 | Strobl et al. | 361/144 |
| 5,813,712 | A | 9/1998 | Mozelt | |
| 5,875,281 | A | 2/1999 | Thexton et al. | |
| 5,905,624 | A | 5/1999 | Andreica et al. | |
| 6,088,210 | A * | 7/2000 | Goodman | 361/160 |
| 6,710,574 | B2 | 3/2004 | Davis et al. | |
| 7,461,569 | B2 | 12/2008 | Bianchi | |
| 7,495,879 | B2 * | 2/2009 | Thexton et al. | 361/144 |
| 7,697,253 | B1 * | 4/2010 | Maraval | 361/144 |
| 2005/0094345 | A1 * | 5/2005 | Pollock et al. | 361/120 |
| 2008/0143260 | A1 | 6/2008 | Tuymer et al. | |
| 2009/0160590 | A1 | 6/2009 | Maraval et al. | |
| 2009/0161284 | A1 | 6/2009 | Maraval | |

FOREIGN PATENT DOCUMENTS

| | | | |
|---|---|---|---|
| CN | 2920948 | Y | 7/2007 |
| DE | 2610781 | A1 | 9/2007 |
| JP | 05343222 | A * | 12/1993 |
| JP | 09142770 | A * | 6/1997 |
| JP | 2002359112 | A | 12/2002 |
| JP | 2004299821 | A | 10/2004 |
| WO | WO 2009/086171 | | 7/2009 |

OTHER PUBLICATIONS

International Search Report from PCT/US2008/087785, Apr. 6, 2009, 5 pages.

* cited by examiner

*Primary Examiner* — Ronald W Leja
(74) *Attorney, Agent, or Firm* — Knobbe, Martens, Olson & Bear, LLP

(57) ABSTRACT

A magnet controller supplied by a DC generator controls a lifting magnet. Four transistors, forming an H bridge, allow DC current to flow in both directions in the lifting magnet. During "Lift", full voltage is applied to the lifting magnet. During "Drop", reverse voltage is applied briefly to demagnetize the lifting magnet. At the end of the "Lift" and the "Drop", most of the lifting magnet energy is returned to the DC generator. A transient voltage suppressor protects against voltage spike generated when current reverses in the generator.

22 Claims, 24 Drawing Sheets

SECONDARY DISCHARGE

OPEN CIRCUIT IN LIFT

FREEWHEEL TVS PROTECTION
MODE AFTER LIFT

OPEN CIRCUIT IN DROP

FREEWHEEL TVS PROTECTION
MODE AFTER DROP

| | | | | |
|---|---|---|---|---|
| FIG.13A | FIG.13B | FIG.13C | FIG.13D | |
| FIG.13E | FIG.13F | | | |
| FIG.13G | FIG.13H | FIG.13I | FIG.13J | FIG.13K |

FIG. 13

METHOD AND APPARATUS FOR CONTROLLING A LIFTING MAGNET OF A MATERIALS HANDLING MACHINE

RELATED APPLICATION

This application is a continuation of U.S. patent application Ser. No. 11/757,304, filed Jun. 1, 2007, which is hereby incorporated herein by referenced in its entirety.

BACKGROUND

1. Field of the Invention

The present invention relates to a method and apparatus for controlling a lifting magnet of a materials handling machine for which the source of DC electrical power is a DC generator. It finds particular application in conjunction with lifting magnets used on crawlers in the scrap metal industries.

2. Prior Art

Lifting magnets are commonly attached to crawler booms to load, unload, and otherwise move scrap steel and other ferrous metals.

While lifting magnets have been in common use for many years, the systems used to control these lifting magnets remain relatively primitive. During the "Lift", a DC current energizes the lifting magnet in order to attract and retain the magnetic materials to be displaced. At the end of the "Lift", when the materials need to be separated from the lifting magnet, most of the controllers automatically apply a reversed voltage across the lifting magnet for a short period of time to allow the consequently reversed current to reach a fraction of the "Lift" current. This phase is known as the "Drop" phase, during which a magnetic field in the lifting magnet of the same magnitude but in an opposite direction of the residual magnetic field is produced that the two fields cancel each other. When the lifting magnet is free of residual magnetic field, all scrap metal detaches freely from the lifting magnet. This is known as a "Clean Drop".

Some known control systems operate to selectively open and close contacts that, when closed, complete a "Lift" or "Drop" circuit between the DC generator and the lifting magnet. At the end of the "Lift", which is called the "discharge" and at the end of the "Drop", which is called the "secondary discharge", these systems generally use either a resistor or a varistor to discharge the lifting magnet's energy. The higher the resistor's resistance value or varistor breakdown voltage, the faster the lifting magnet discharges, but also the higher the voltage spike across the lifting magnet. High voltage spikes cause arcing between the contacts. In addition, fast rising voltage spikes also eventually wear out the DC generator collector and its winding insulation, the lifting magnet insulation, and the insulation of the cables connected to the lifting magnet and the generator. To withstand these voltage spikes, generally in the magnitude of 750 V DC with systems using DC generators rated 240 V DC, the lifting magnet, cables, and the control system contacts and other components must be constructed of more expensive materials, and must also be made larger in size. These systems waste lifting magnet's energy. Lifting magnet's energy is transformed into heat, dissipated through a voltage suppressor or resistor bank. This results in poor system efficiency and oversized components to dissipate the heat.

To avoid these issues, some other known control systems connect directly to DC generator excitation shunt field. They eliminate arcing across contacts and minimize voltage spikes in the lifting magnet circuit but at the expense of a slower response time, caused by the induced DC generator time constant.

SUMMARY

A new and improved method and apparatus for controlling a lifting magnet is provided.

In one embodiment, the lifting magnet energy produced during the "Lift" phase is returned to the DC generator which in turn converts it back into mechanical energy.

In one embodiment, a Transient Voltage Suppressor (TVS) is provided to control DC generator maximum voltage when current is reversed in the DC generator.

In one embodiment, a circuit is provided to protect the TVS against overload. TVS overload can occur, for example, by accidental disconnection between the controller and the DC generator such that energy stored in the lifting magnet cannot be returned to the DC generator.

In one embodiment, at least a portion of the energy stored in the lifting magnet is returned to the source rather than being dissipated in resistor, varistor, or other lossy elements.

In one embodiment, switching of current for the magnet is provided by solid-state devices.

In one embodiment, the control system is configured to reduce voltage spikes in the lifting magnet circuit.

In one embodiment, the control system is configured to increase the useful life of the lifting magnet, the generator supplying power to the lifting magnet, and/or the associated circuitry.

In one embodiment, the control system is configured to reduce the "Drop" time. Shorter "Drops" helps to increase production by reducing lifting magnet cycle times. Some existing systems are using a resistor, which causes voltage to decay with the current leading to a longer discharge time. This invention uses a constant voltage source provided by the DC generator to discharge the lifting magnet energy, allowing a faster discharge.

DETAILED DESCRIPTION

Figure 1:
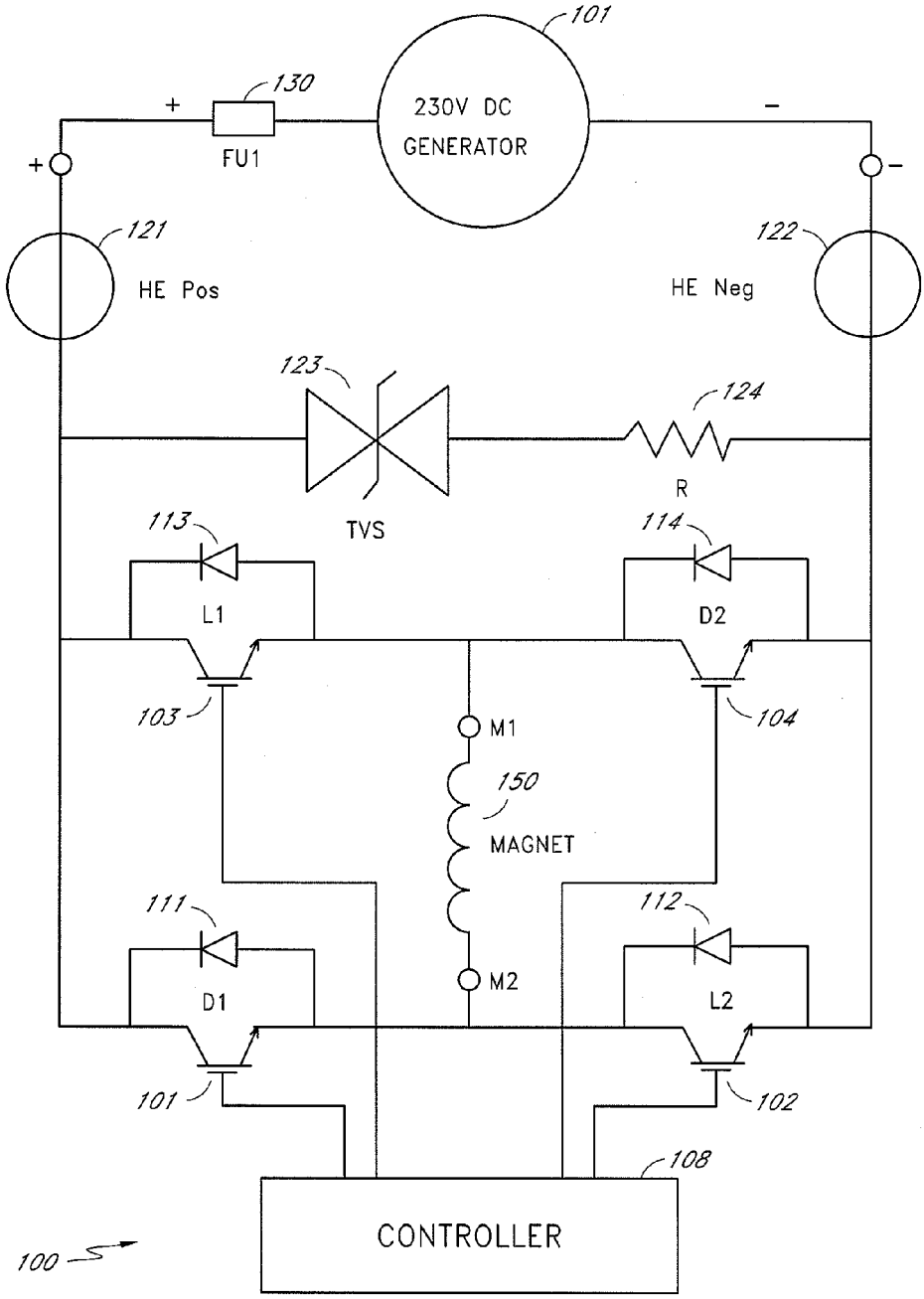
FIG. 1 schematically illustrates a lifting magnet controller circuit.

FIG. 1 schematically illustrates a lifting magnet controller circuit that includes a logic controller 108. Outputs from the logic controller 108 are provided to respective switches 101, 102, 103 and 104. One of ordinary skill in the art will recognize that logic controller 108 can be a Printed Circuit Board, Programmable Logic Controller, etc. The switches 101-104 are configured in an "H" bridge arrangement to provide current to a magnet 150. The switches 101-104 can be any type of mechanical or solid-state switch device so long as the devices are capable of switching at a desired speed and can withstand the desired current and voltage. For convenience, and not by way of limitation, FIG. 1 shows the switches 101-104 as insulated gate bipolar transistors. One of ordinary skill in the art will recognize that the switches 101-104 can be bipolar transistors, insulated gate bipolar transistors, field-effect transistors, MOSFETs, etc.

In FIG. 1, a first output from the logic controller 108 is provided to a gate of the switch 101, a second output from the logic controller 108 is provided to a gate of the switch 102, a third output from the logic controller 108 is provided to a gate of the switch 103, a fourth output from the logic controller 108 is provided to a gate of the switch 104. An emitter from the switch 101 is provided to a first terminal of the magnet 150 and to a collector of the switch 102. An emitter from the switch 103 is provided to a second terminal of the magnet 150 and to a collector of the switch 104. Flyback diodes 111-114 are provided to respective collectors and emitters of the switches 101-104.

A positive output from a DC generator 101 is provided through a fuse 130 to a first terminal of a current sensor 121. A second terminal of the current sensor 121 is provided to a first terminal of a transient voltage suppressor (TVS) 123, and to the collectors of the switches 101 and 103. A negative output from the DC generator 101 is provided through a current sensor 122 to a first terminal of a resistor 124 and to the emitters of the switches 102 and 104. A second terminal of the resistor 124 is provided to a second terminal of the TVS 123.

The transistors, 103 and 102 form the "Lift" circuit, and transistors 101 and 104 form the "Drop" circuit. One of ordinary skill in the art will recognize that when any of the diodes 111-114 are forward biased, the switch 101-104 can be closed to provide a current path in parallel with the diode (e.g., to protect the diode, to provide a lower impedance path for current, etc.) Thus, for example, during discharge and/or drop, the switches 104 and 101 can be closed to provide current through the switches, or open to allow current to flow through the respective diodes. The current sensors 121, 122 can be configured as Hall Effects sensors, current shunts, resistors, current transformers, etc. The current sensors 121, 122 monitor current and detect "Drop current threshold" current, short-circuits, and ground faults. The system 100 (shown in FIGS. 1 and 3-12 as the system 100 with the addition of the generator 101, the fuse 130 and the magnet 150). controls the maximum voltage when current reverses direction in the generator. The resistor 124 is provided to monitor energy dissipated in the TVS 123.

Figure 2:
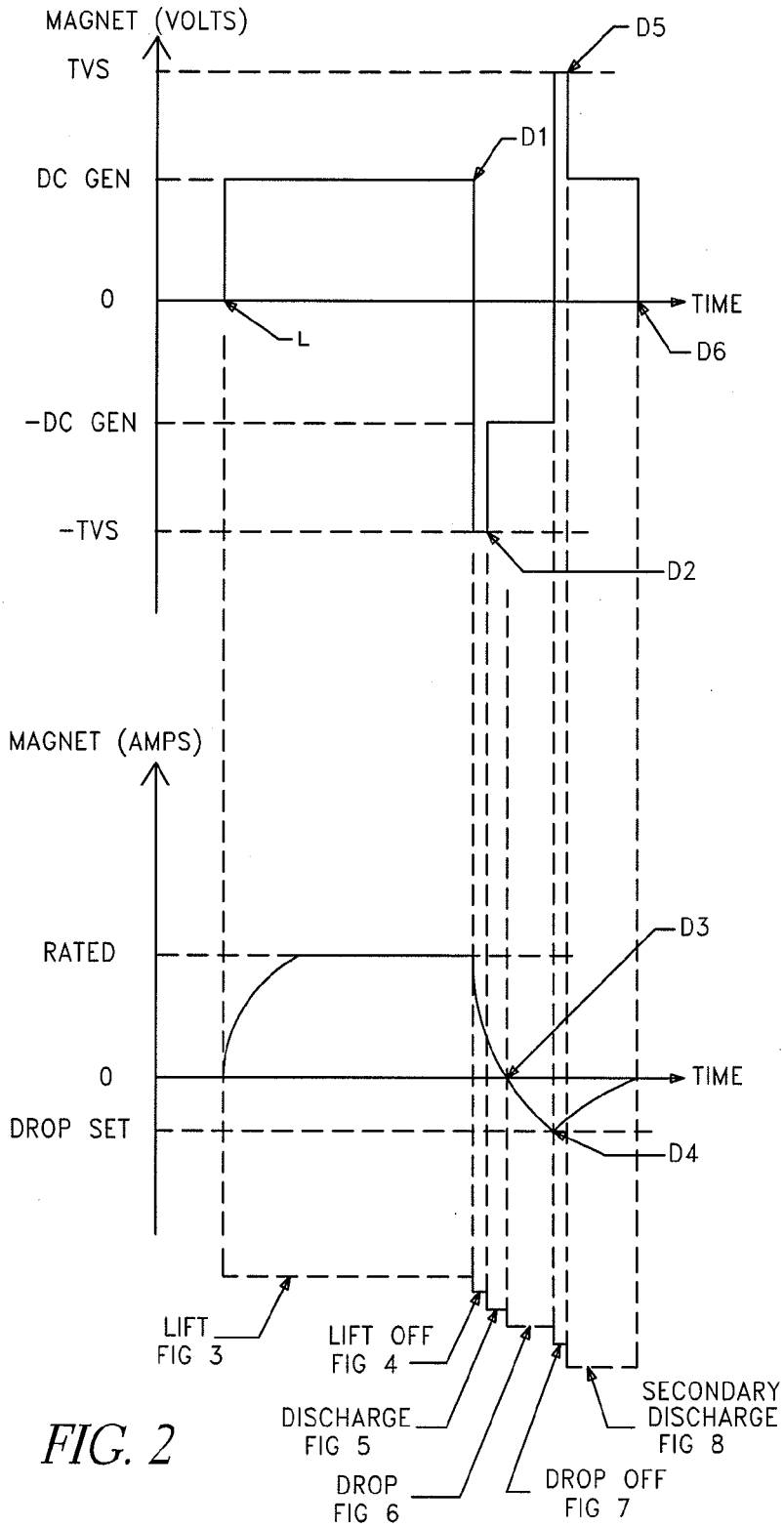
FIG. 2 graphically shows a voltage and current signals as the lifting magnet is operated through "Lift" and "Drop" cycle.
Figure 3:
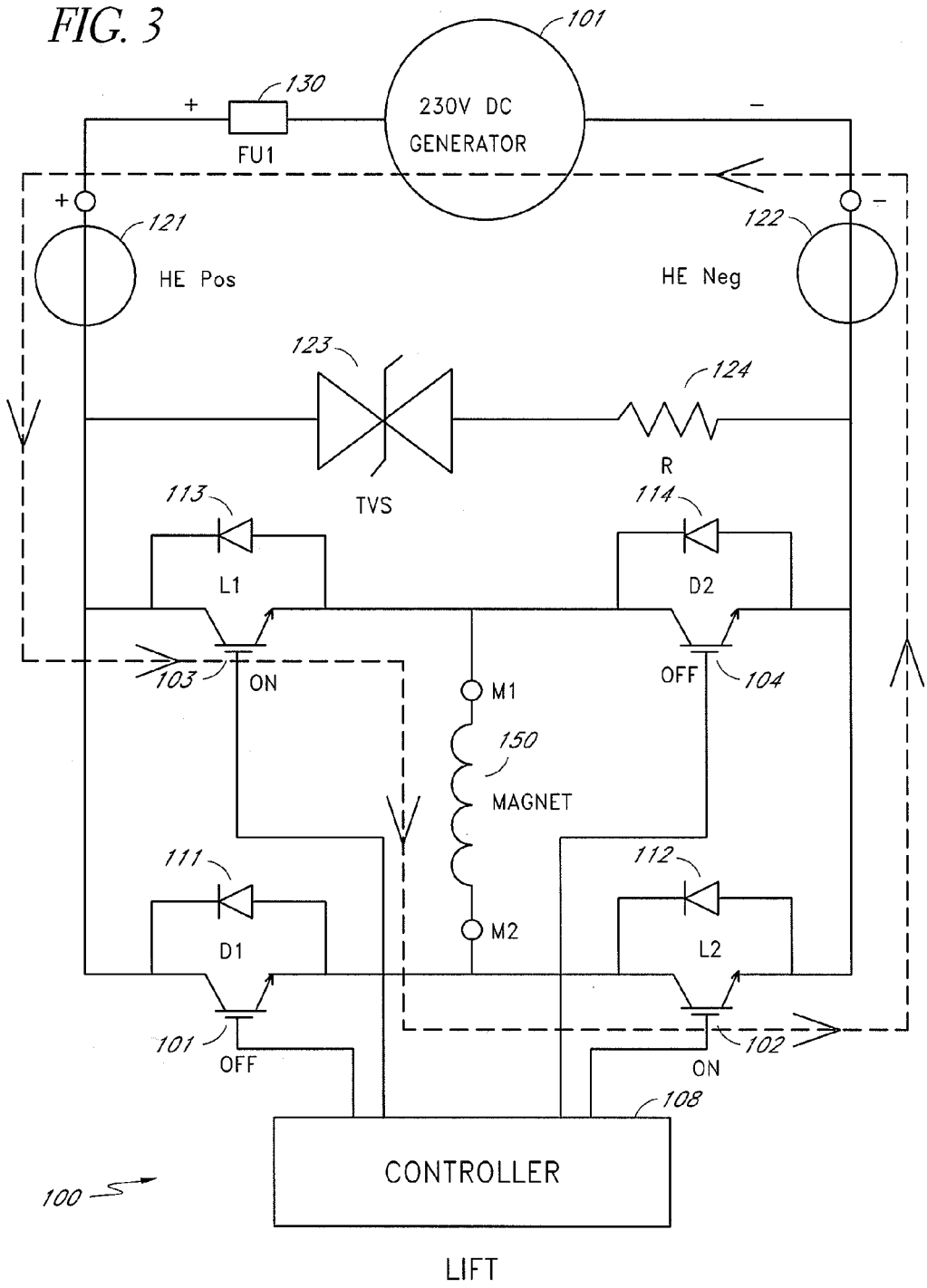
FIG. 3 shows the circuit of FIG. 1 during the "Lift" mode.
Figure 5:
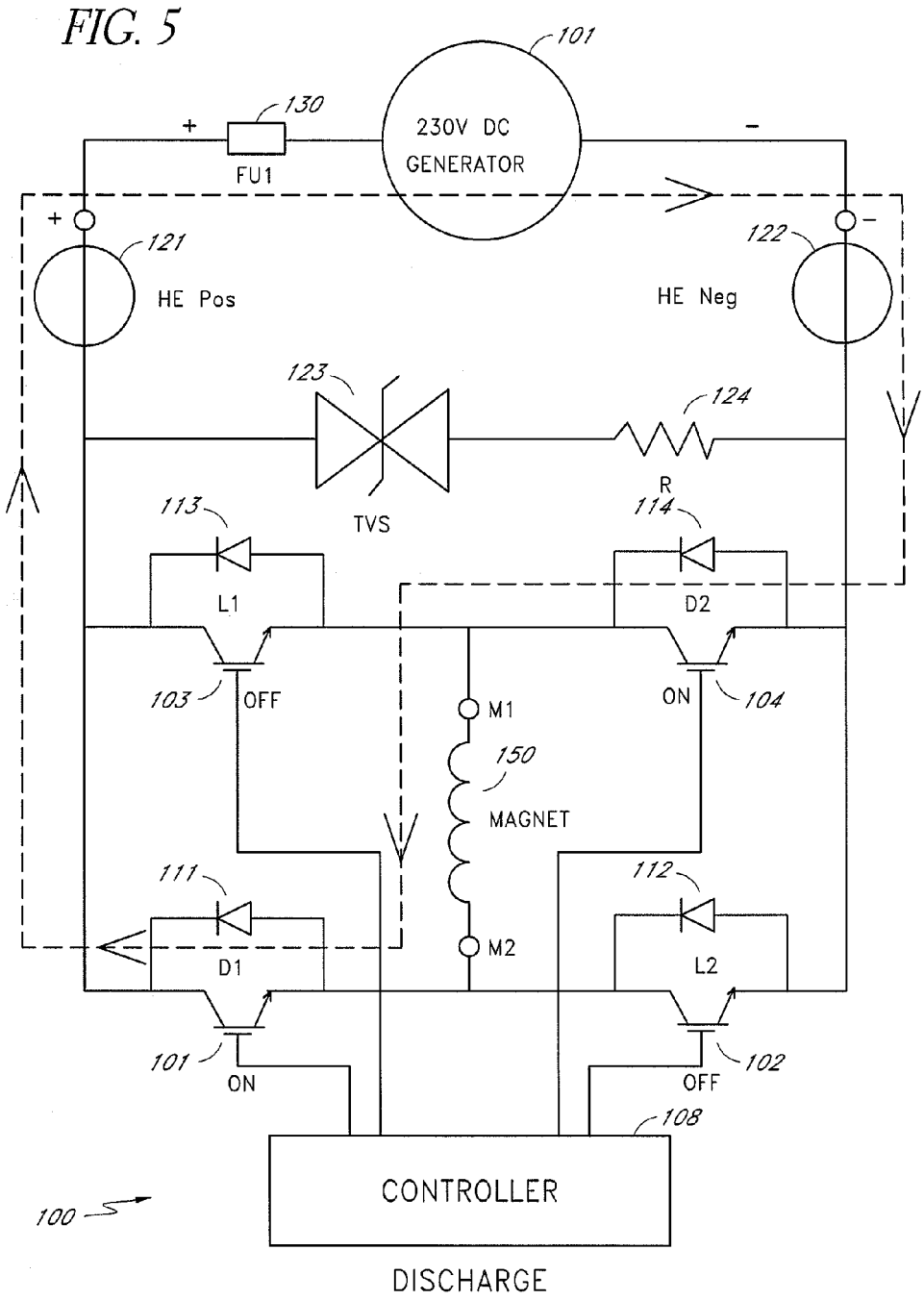
FIG. 5 shows the circuit of FIG. 1 during the Discharge mode.
Figure 6:
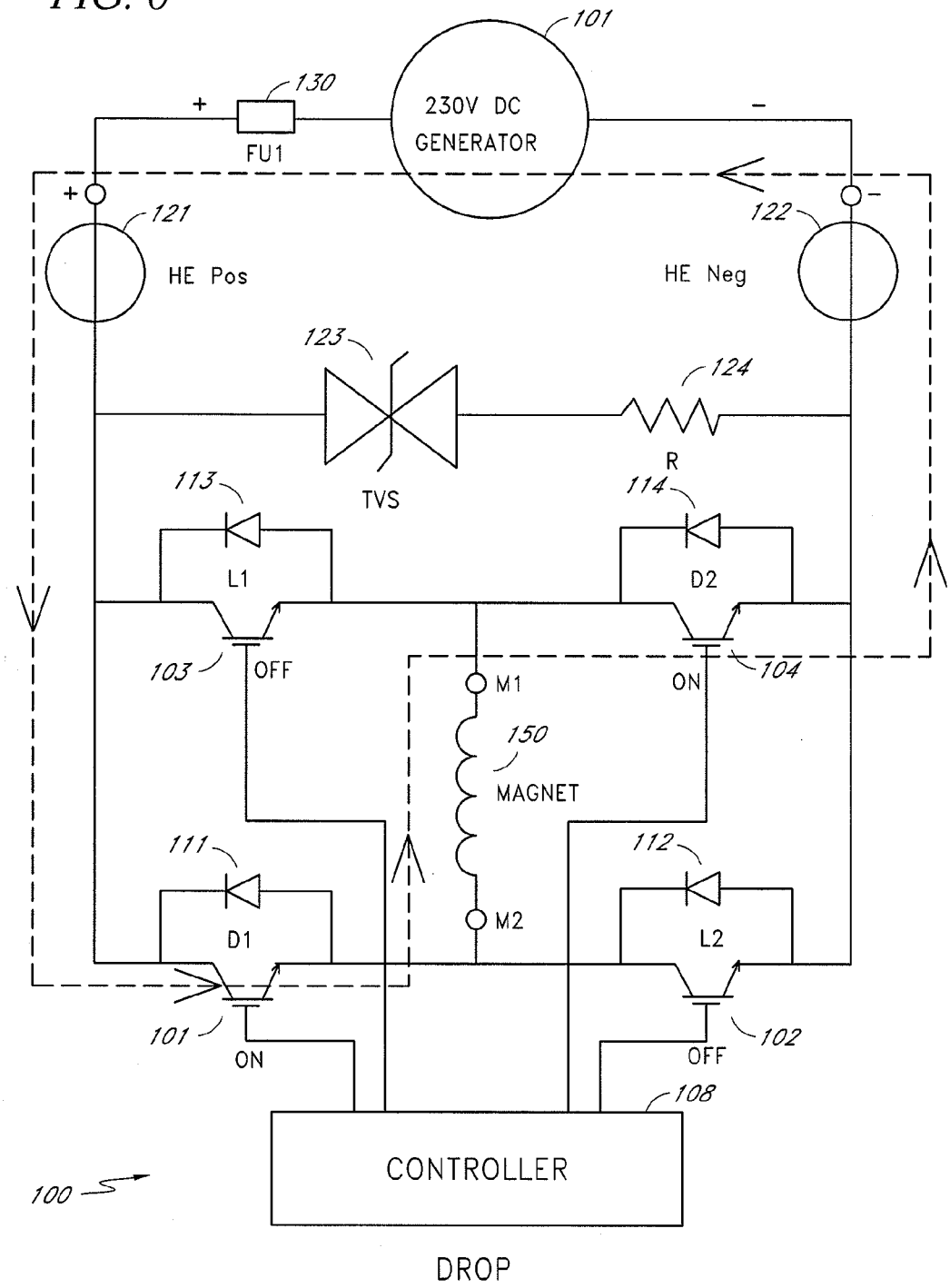
FIG. 6 shows the circuit of FIG. 1 during the "Drop" mode.

FIG. 2 shows voltage and current during the lift mode. When the operator activates "Lift" at time "L", the logic controller 108 closes the switches 103 and 102. Current flows from the generator 101 to the magnet 150. Current from the DC generator 101 is applied to the lifting magnet through the switches 103 and 102 as shown in FIG. 3, and the current ramps to the lifting magnet rated current value. The operator ends "Lift" at time "D1", whereupon the circuit is configured shown in FIG. 4, the voltage rises to the TVS breakdown value, and the current in the lifting magnet decays. When the current direction reverses in the DC generator (at time D2), the circuit is as shown in FIG. 5 where the lifting magnet energy discharges into the DC generator. When the lifting magnet energy is released (at time D3), current in the lifting magnet reaches zero and then starts to ramp in the reverse direction as shown in FIG. 6. When the current value becomes equal to the "Drop current threshold" (at time D4), the circuit is in the configuration shown in FIG. 7, the voltage steps to TVS breakdown value, and the current in the lifting magnet decays. When the current direction reverses in the DC generator (at time D5), the circuit is as shown in FIG. 8, the lifting magnet energy discharges into the DC generator, and the current decays until substantially all lifting magnet energy is released (at time D6).

FIG. 3 shows current in the system 100 during the "Lift" mode. During lift, the logic controller 108 keeps the switches 101 and 104 open (e.g., off), and closes (e.g., turns on) the switches 103 and 102. Current flows from the positive terminal of the DC generator 101 through the switch 103, through the lifting magnet 150, through the switch 102 and back to the generator 101. Rated current establishes in the lifting magnet 150 after a few seconds, based on the time constant of the circuit, which is primarily due to the inductance to resistance ratio (L/R) of the lifting magnet 150.

Figure 4:
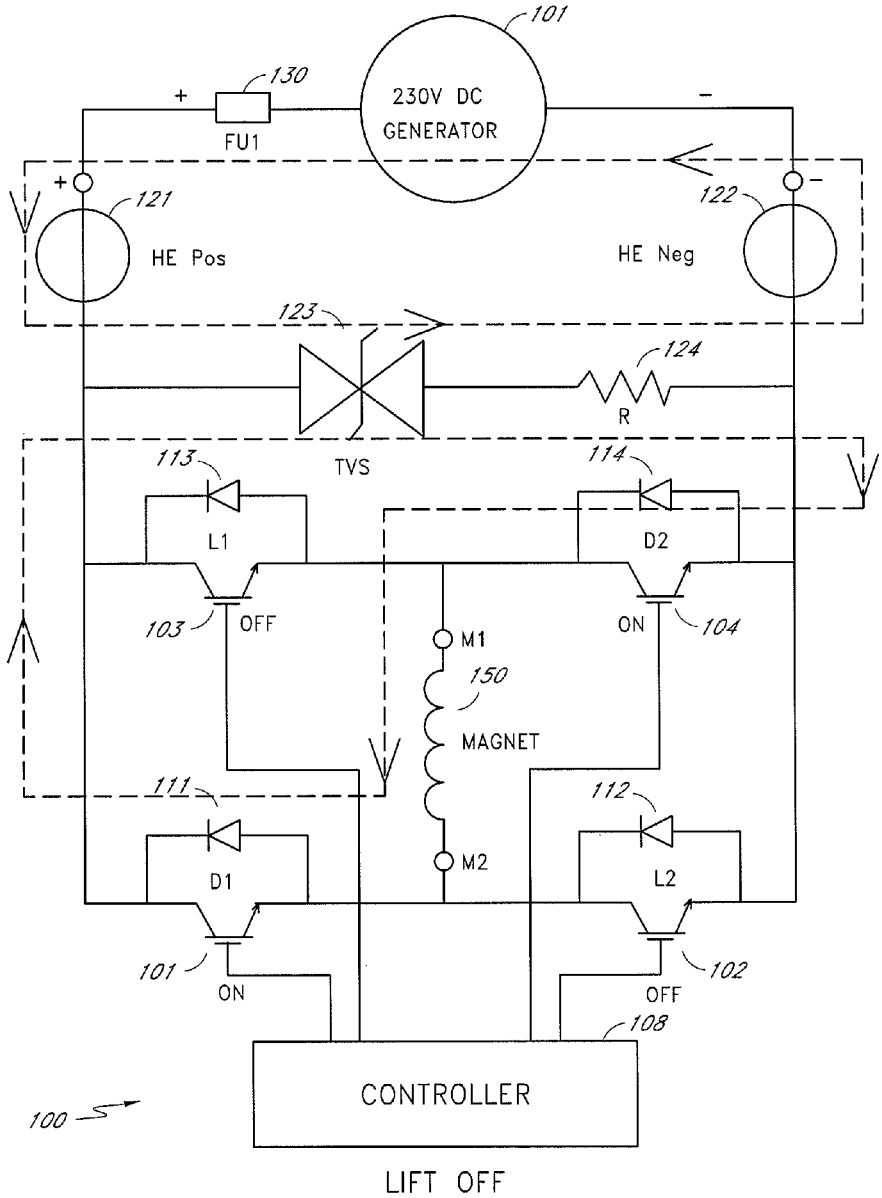
FIG. 4 shows the circuit of FIG. 1 during the "Lift" off mode.

FIG. 4 shows current in the system 100 during the "Lift" off mode. When operator needs to release the material being lifted by the magnet, the operator instructs the logic controller 108 to start the drop process. The drop process includes lift off (FIG. 4), discharge (FIG. 5), drop (FIG. 6), drop off (FIG. 7) and secondary discharge (FIG. 8). During lift off, switches 103 and 102 are turned off and a few milliseconds later switches 101 and 104 are turned on. Due to the inductance of the generator, the generator current is still flowing in the same direction as it was flowing during "Lift". Because the switches 103 and 102 are off, the generator current flows through the TVS 123. Due to the inductance of the lifting magnet, the lifting magnet current is still flowing in the same direction as it was flowing during "Lift". So, if for example, during "Lift", a current of 100 Amps was flowing through the DC generator 101 and the lifting magnet 150, at the time 103 and 102 turn off, a current of 200 amperes flows through the TVS 123, with the DC generator 101 contributing for 100 amperes, and the lifting magnet 150 contributing for 100 amperes.

FIG. 5 shows current in the system 100 during the discharge mode. The lifting magnet 150 has a longer time constant than the DC generator 101, so the direction of current will reverse in the DC generator 101 before it can reverse in the lifting magnet 150. When the DC generator 101 allows current to reverse its direction, the lifting magnet current flows back into the DC generator 101. The difference of potential $V_{M2}$-$V_{M1}$ across the lifting magnet is positive. Therefore, the lifting magnet 150 acts as a source of energy, and energy from the lifting magnet is transferred from the lifting magnet 150 to the DC generator 101.

FIG. 6 shows current in the system 100 during the "Drop" mode. During drop mode, switches 101 and 104 are closed. When there is insufficient energy left in the lifting magnet 150 to maintain the reverse current flow into the DC generator 101, the DC generator 101 generates a "reverse" current in the lifting magnet 150. Based on the time constant of the circuit, the reverse current gradually increases.

In one embodiment, the switches 101 and 104 are closed during the lift-off phase. Since the flyback diodes 114 and 111 are forward biased during the lift-off phase, the switches 101, 104 need not to be forward biased (in other words, the switches 101, 104 can be closed by the logic controller 108 but nevertheless not conducting current because they are reversed biased). Once the magnet 150 is discharged, the current through the magnet will reverse during the drop phase and thus the switches 101, 104 will become forward biased.

Figure 7:
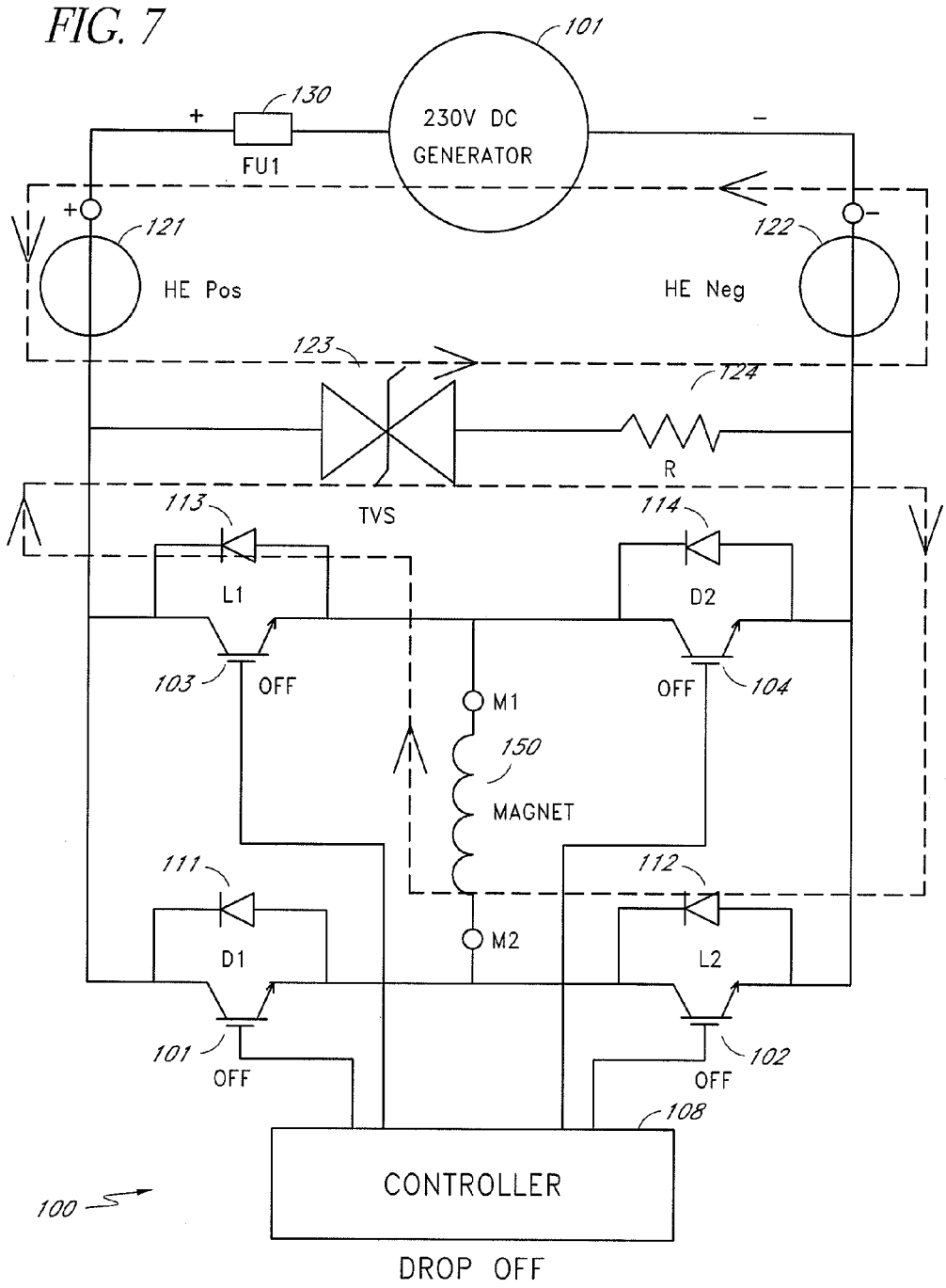
FIG. 7 shows the circuit of FIG. 1 during the "Drop" off mode.
Figure 8:
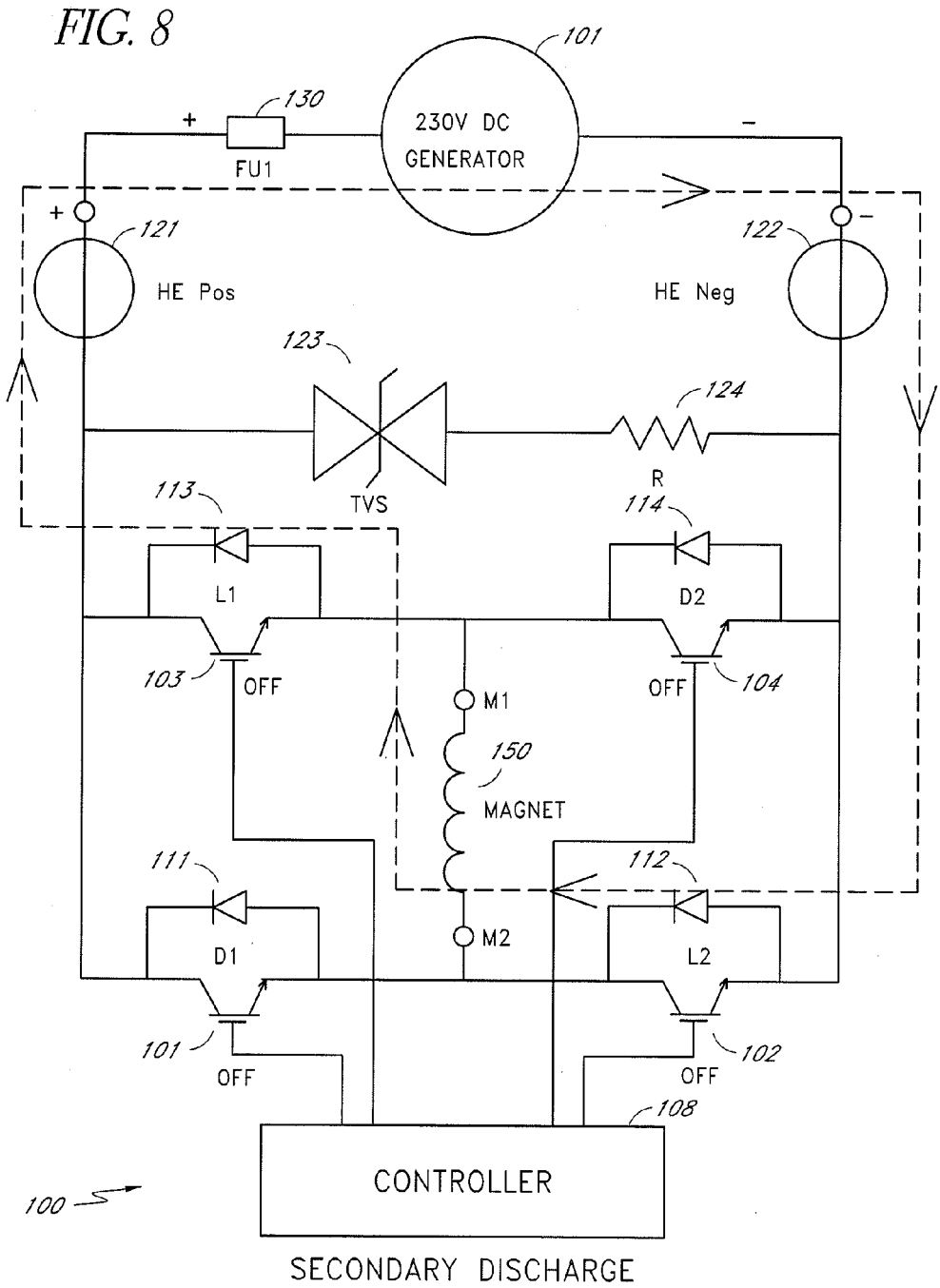
FIG. 8 shows the circuit of FIG. 1 during the secondary discharge mode.

FIG. 7 shows current in the system 100 during the "Drop" off mode. When the current measured by the current sensor 121 (and/or the current sensor 122) matches the "Drop current threshold", the logic controller turns the switches 101 and 104 off. Due to the inductance of the generator 101, the generator current is still flowing in the same direction as it was flowing during "Drop". Because all of the switches 101-104 are off, generator current flows through the TVS 123. Due to the inductance of the lifting magnet 150, the lifting magnet current is still flowing in the same direction as it was flowing during "Drop". If for example, during the "Drop" a "reverse" current of 20 Amps was flowing through the DC generator and the lifting magnet, at the time the switches 101 and 104 turn off, 40 amperes would flow in the TVS 123, with the DC generator 101 contributing for 20 amperes, and the lifting magnet 150 contributing for 20 amperes.

FIG. 8 shows current in the system 100 during secondary discharge. The lifting magnet 150 has a longer time constant than the DC generator 101, so the direction of current will reverse in the DC generator 101 before it can reverse in the lifting magnet 150. When the DC generator 101 allows current to reverse its direction, the lifting magnet current flows back into the DC generator 101. The difference of potential $V_{M1}$-$V_{M2}$ across the lifting magnet is positive. Therefore the lifting magnet 150 acts as a source of energy, and energy is transferred from the lifting magnet 150 to the DC generator 101. Then the "reverse" current into the generator 101 gradually decays to zero when all the energy left in the lifting magnet 150 is dissipated.

Figure 9:
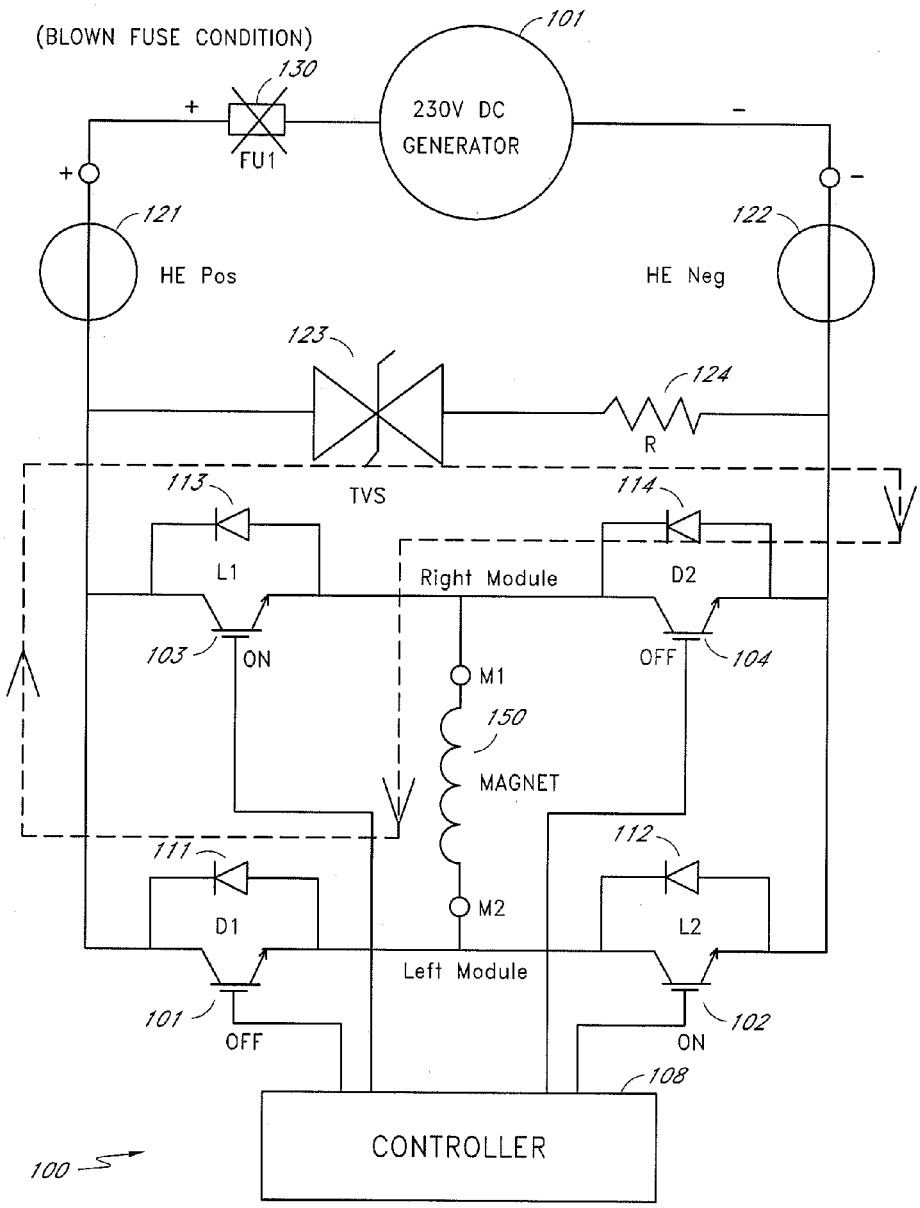
FIG. 9 shows the circuit of FIG. 1 during an open circuit in the "Lift" mode.

FIG. 9 shows current in the system 100 during an open circuit in the "Lift" mode. If during "Lift", the DC generator 101 is accidentally disconnected, such as in the case of a loose connection or if the fuse 130 opens, the path for the lifting magnet current is through the circuit formed by the diodes 111, 114 and the TVS 123. In one embodiment, the TVS is not sized to absorb all the lifting magnet energy. The logic controller 108 measures the current in the TVS 123 by sensing a voltage across the resistor 124. If excess current in the TVS 123 is detected, then the circuit switches into "Freewheel TVS protection" mode to protect the TVS 123 against overload.

Figure 10:
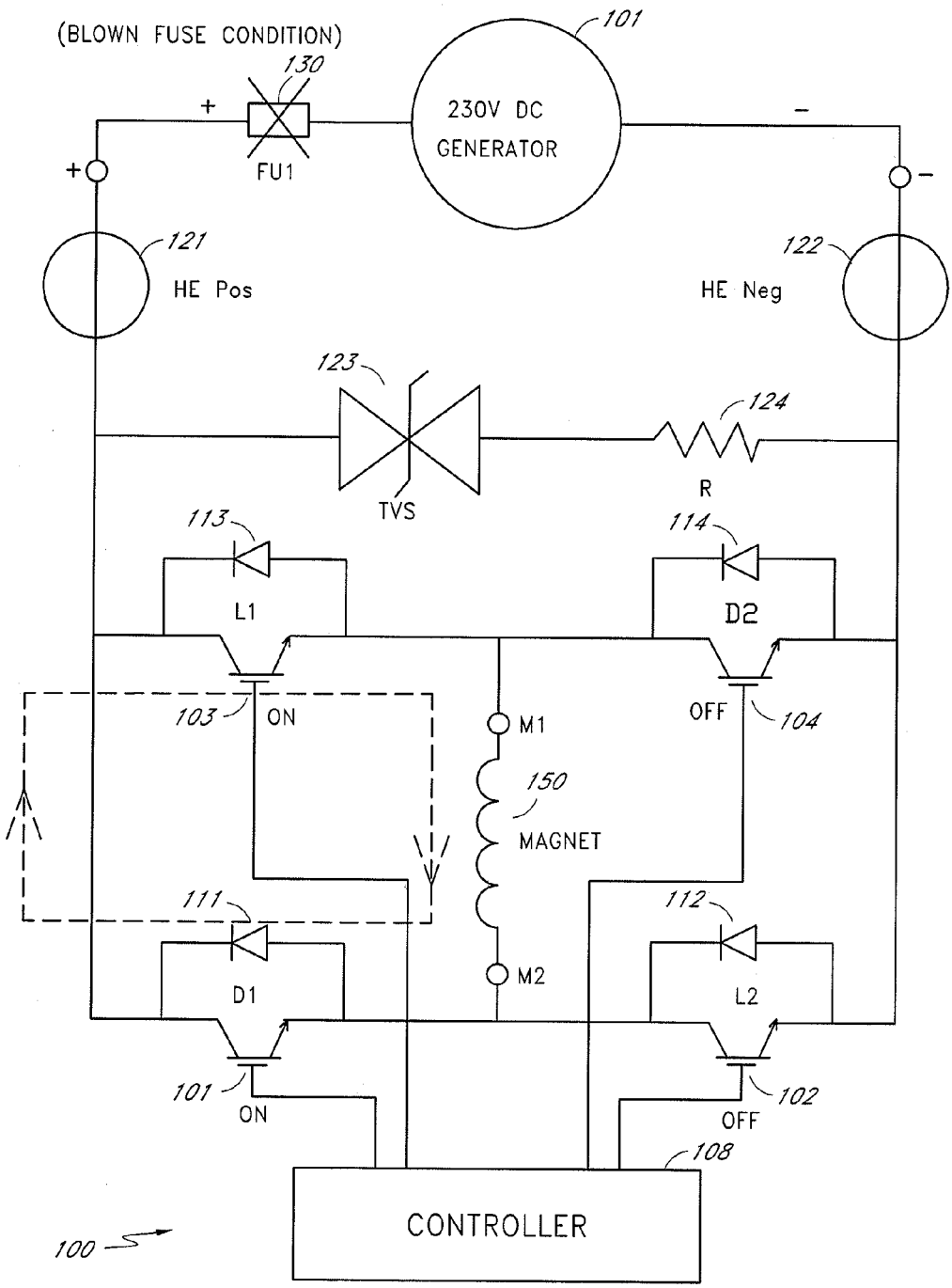
FIG. 10 shows the circuit of FIG. 1 during the Freewheel TVS protection mode after the "Lift" mode.

FIG. 10 shows current in the system 100 during the "Freewheel TVS protection" mode after an open circuit in the "Lift" mode. In the "Freewheel TVS protection" mode, the switch 103 is closed and the diode 111 is forward biased, thus providing a loop for the current circulating in the lifting magnet 150 to maintain the same direction that it had during "Lift".

Figure 11:
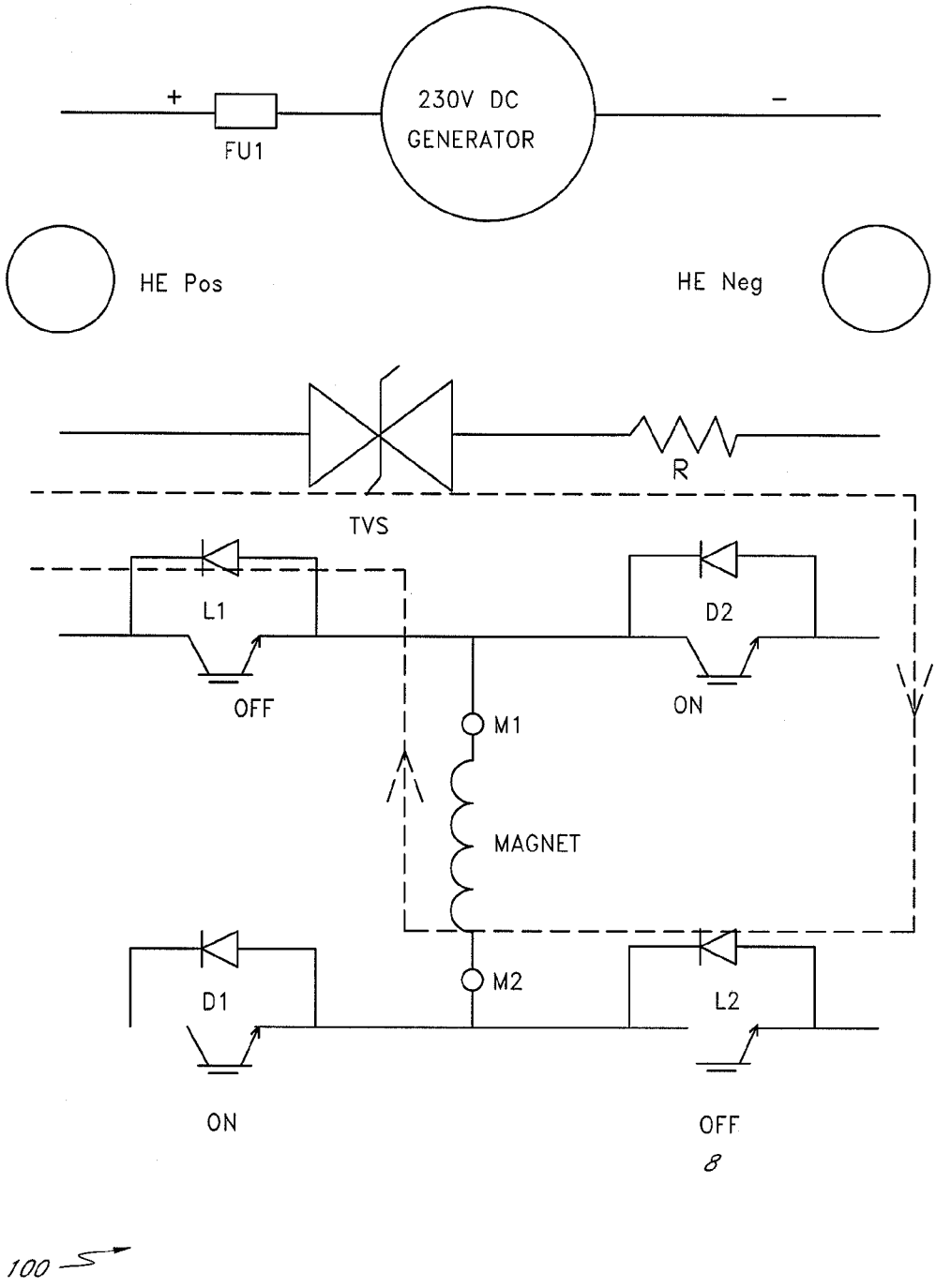
FIG. 11 shows the circuit of FIG. 1 during an Open circuit in the "Drop" mode.

FIG. 11 shows current in the system 100 during an open circuit in the "Drop" mode. If during "Drop", the generator 101 is accidentally disconnected such as in the case of a loose connection or if the fuse 130 opens, the path for the lifting magnet current is through the circuit formed by the diodes 113, 112 and the TVS 123. In one embodiment, the TVS 123 is not sized to absorb all the lifting magnet energy. The logic controller 108 measures the current in the TVS 123 by sensing a voltage across the resistor 124. If excessive current in the TVS 123 is detected, then the circuit switches into "Freewheel TVS protection" mode to protect the TVS 123 against overload.

Figure 12:
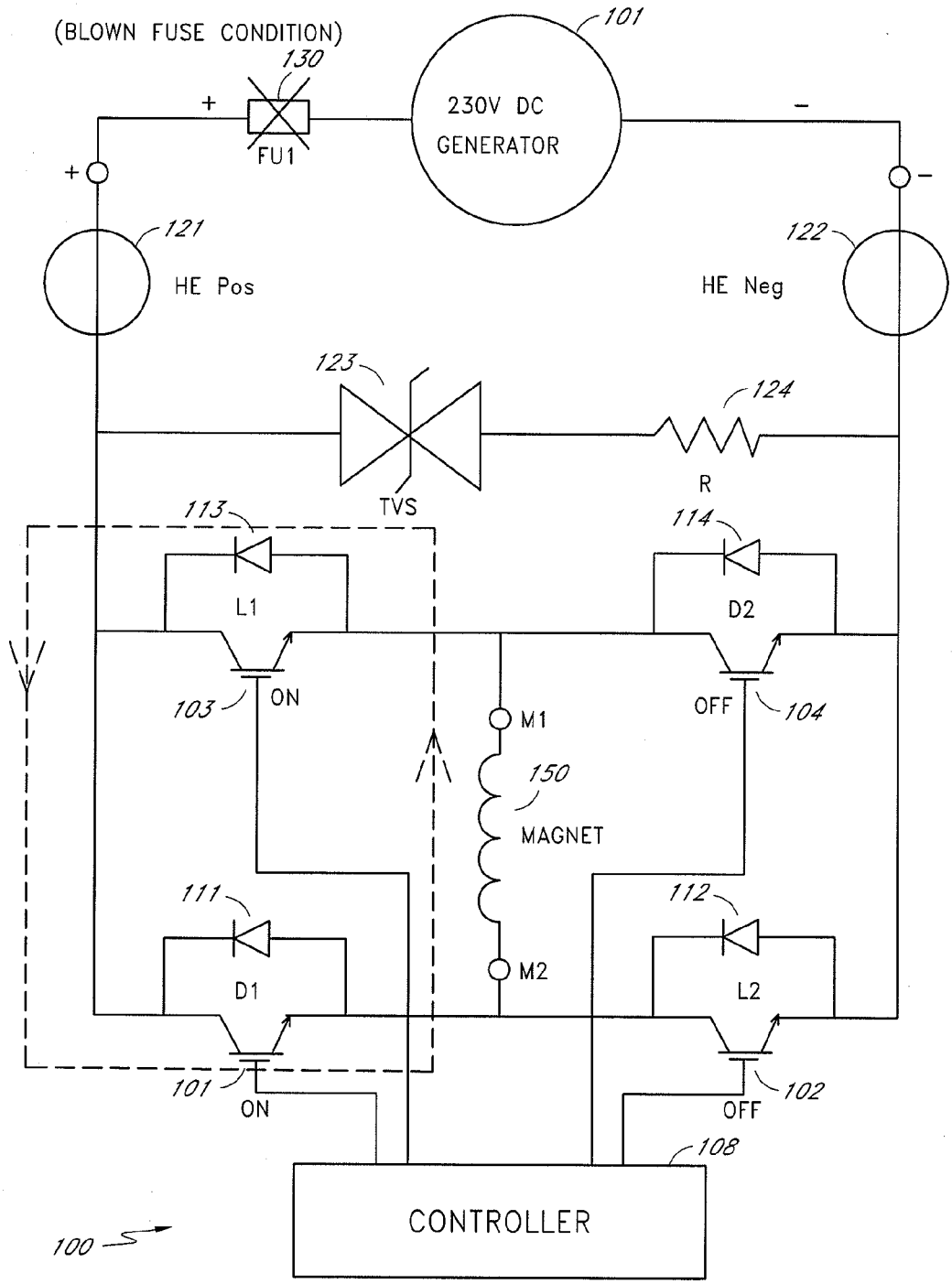
FIG. 12 shows the circuit of FIG. 1 during the Freewheel TVS protection mode after the "Drop" mode.

FIG. 12 shows current in the system 100 during the Freewheel TVS protection mode after an open circuit in the "Drop" mode. In "Freewheel TVS protection" mode, the switch 101 is closed and the diode 113 is forward biased, thus providing a loop for the current circulating in the lifting magnet 150 to maintain the same direction that it had during "Drop".

reewheel TVS protection mode is not polarity sensitive. When a TVS overload is detected, Freewheel TVS protection mode is activated by closing switches 101 and 103 to divert the current from the TVS. As described above, the switch 101 can be closed to form a loop with diode 113, and the switch 103 can be closed to form a loop with diode 111.

Logic controller 108 monitors currents passing through sensors 121 and 122. If an unbalance occurs, then the logic controller 108 signals a ground fault alarm. In one embodiment, the logic controller 108 will turn off the switches 101-104 if an overload condition is detected.

FIG. 13, consisting of FIGS. 13A-13E, is a schematic diagram of one example circuit embodiment for the logic controller. In FIG. 13, a LIFT INPUT is received from a "Lift" user control (e.g., a such as, for example, a lift push button provided to the circuit of FIG. 13 via an opto-isolator). The "Lift" control initiates the "Lift" operation. After the "Lift" push button is released, circuit stays in "Lift". A thermostat that senses the temperature of the one or more of the switches 101-104 (or a heat-sink for the switches 101-104) can be provided to a THERMOSTAT input shown in FIG. 13. If the switches get too hot, the thermostat sends a signal to the THERMOSTAT input that prevents initiation of the next Lift operation, however, a lift currently in progress is not terminated (for safety reasons). A "cycle" control (e.g., push button and associated electronics) can be provided to a CYCLE INPUT. The "Cycle" control can be used to replace (or supplement) the lift and drop controls. Activating the cycle control (e.g., pressing the cycle button) causes the status of the Magnet Controller to cycle through "Lift", then "Drop" and automatically to "OFF", and then again to "Lift" etc. Basically U301A with its complemented output fed in its data input acts as a divider by 2. A POWER UP RESET line is temporary held ON when control power is applied (or after power has been cycled to reset a fault) to set the status of D Type Flip-Flop (latches) in the circuit. A DROP INPUT receives signals from a "Drop" control (e.g., a "Drop" push button and associated opto-isolator and electronics). The "Drop" push button terminates the "Lift" and initiates the "Drop". After the "Drop" push button is released, the circuit finishes "Lift" and then automatically goes to "Off". A NO CONTROL POWER input is configured to receive a signal indicating that the 24V DC power supply has fallen below 18V. A typical 24V to 15V voltage regulator needs at least 18V on its input to guarantee 15V output. So if control power supply is too low, to protect against unexpected behavior, the switches 101-104 are turned off when the NO CONTROL POWER signal is received. The "Drop" current can be adjusted by an optional potentiometer P201. An HE POS input receives current sensor signals from the current sensor 121. An HE NEG input receives current sensor signals from the current sensor 122. A SHORT CIRCUIT input is provided to receive a signal if an overload or short condition is detected. A connector CN521 provides inputs from the TVS current sensor 124. The circuit of FIG. 13 is configured to use a 0.1 ohm resistor as the TVS current sensor. If a TVS overload signal is received at the TVS input, the switches 101 and 103 are then turned on to protect 123.

Figure 13A:
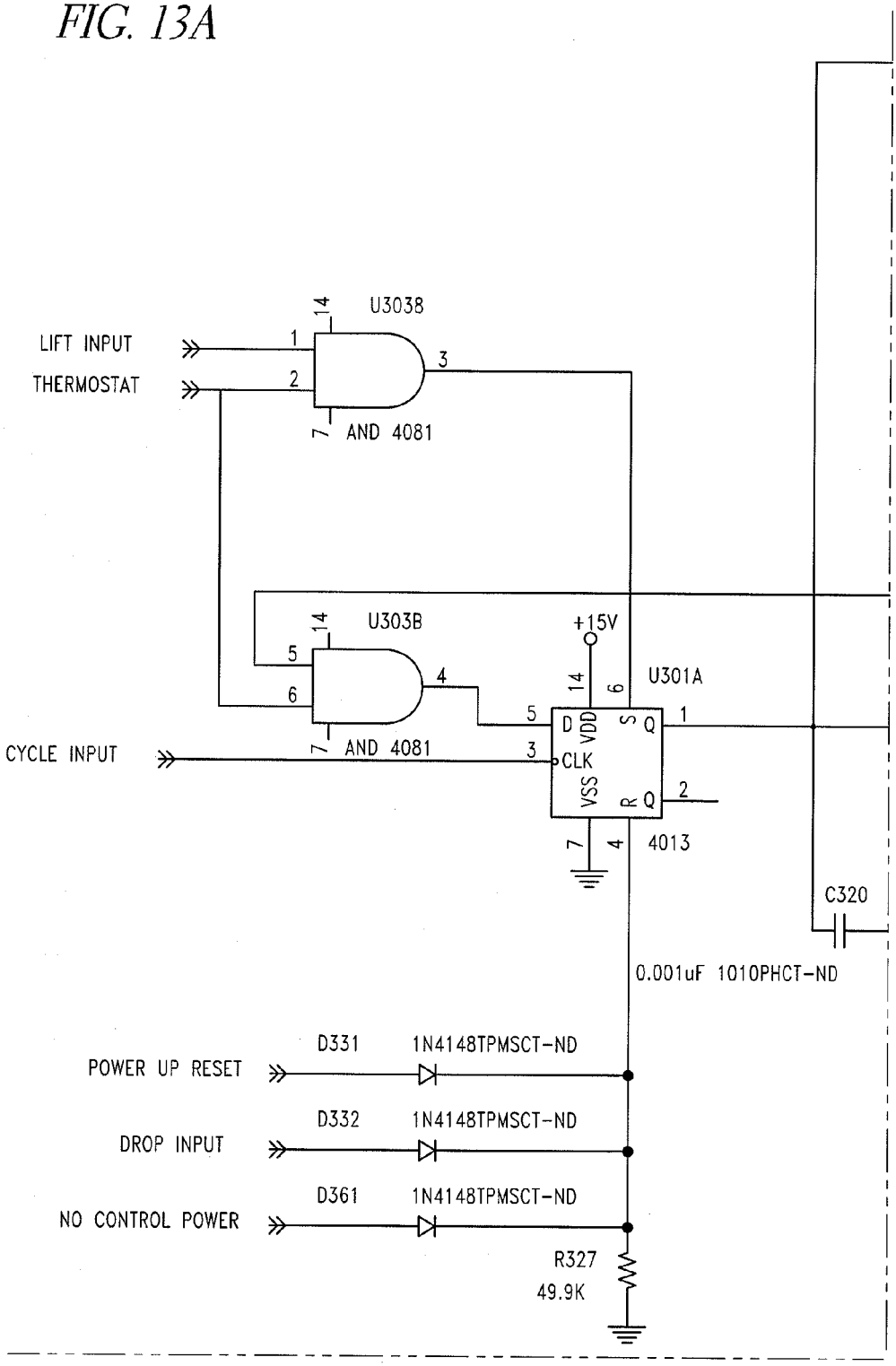
FIG. 13, consisting of FIGS. 13A-13K, is a schematic diagram of one embodiment of the logic controller.
Figure 13B:
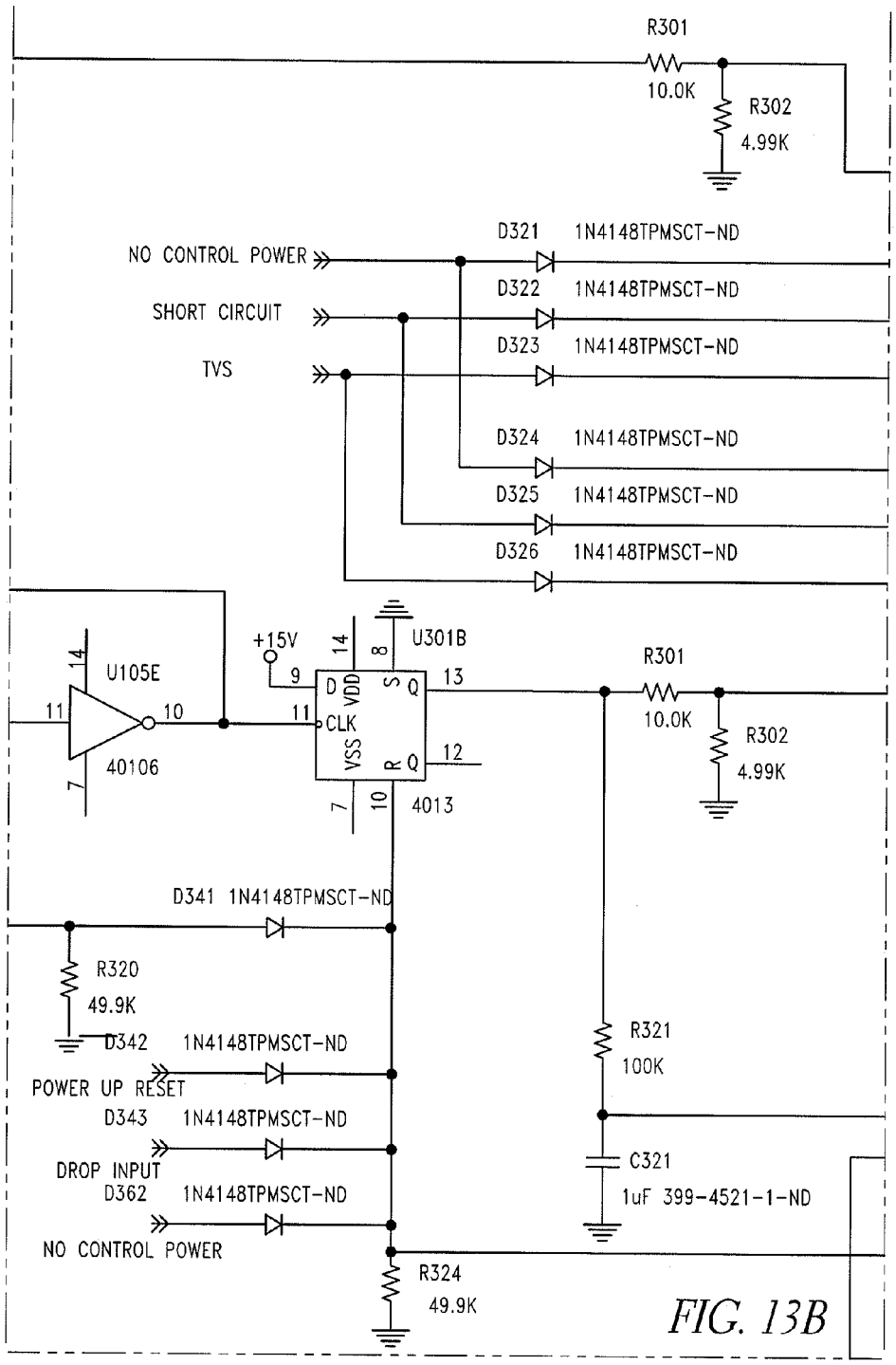
Figure 13C:
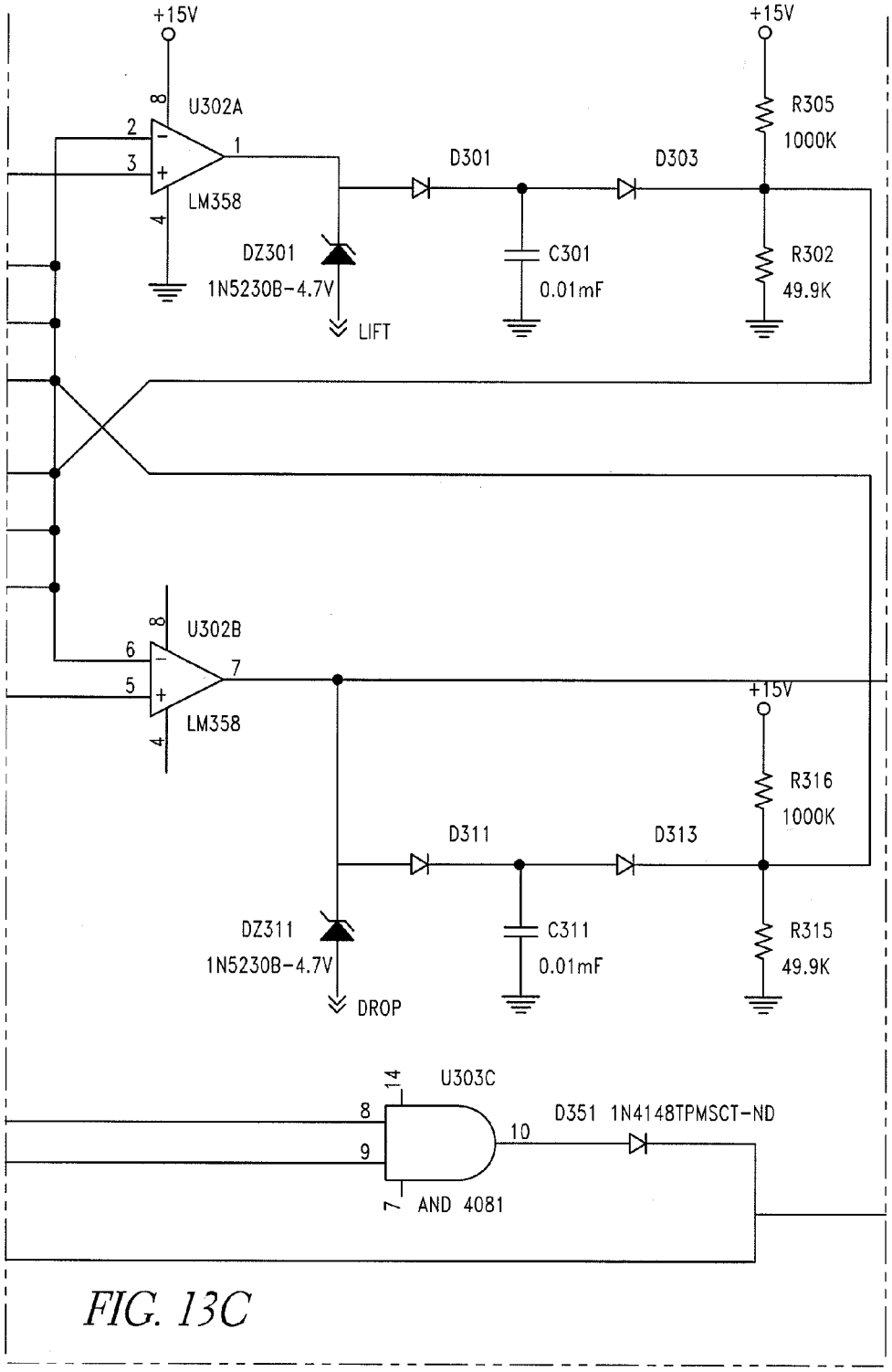
Figure 13D:
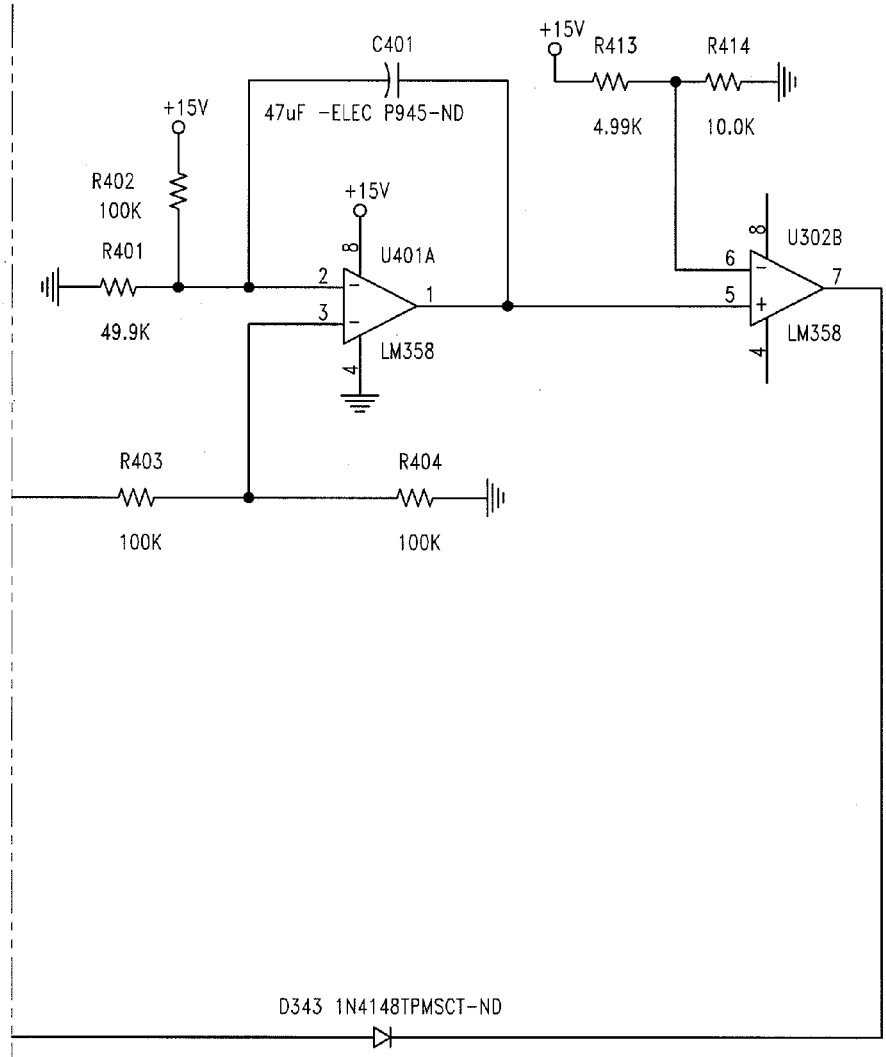
Figure 13E:
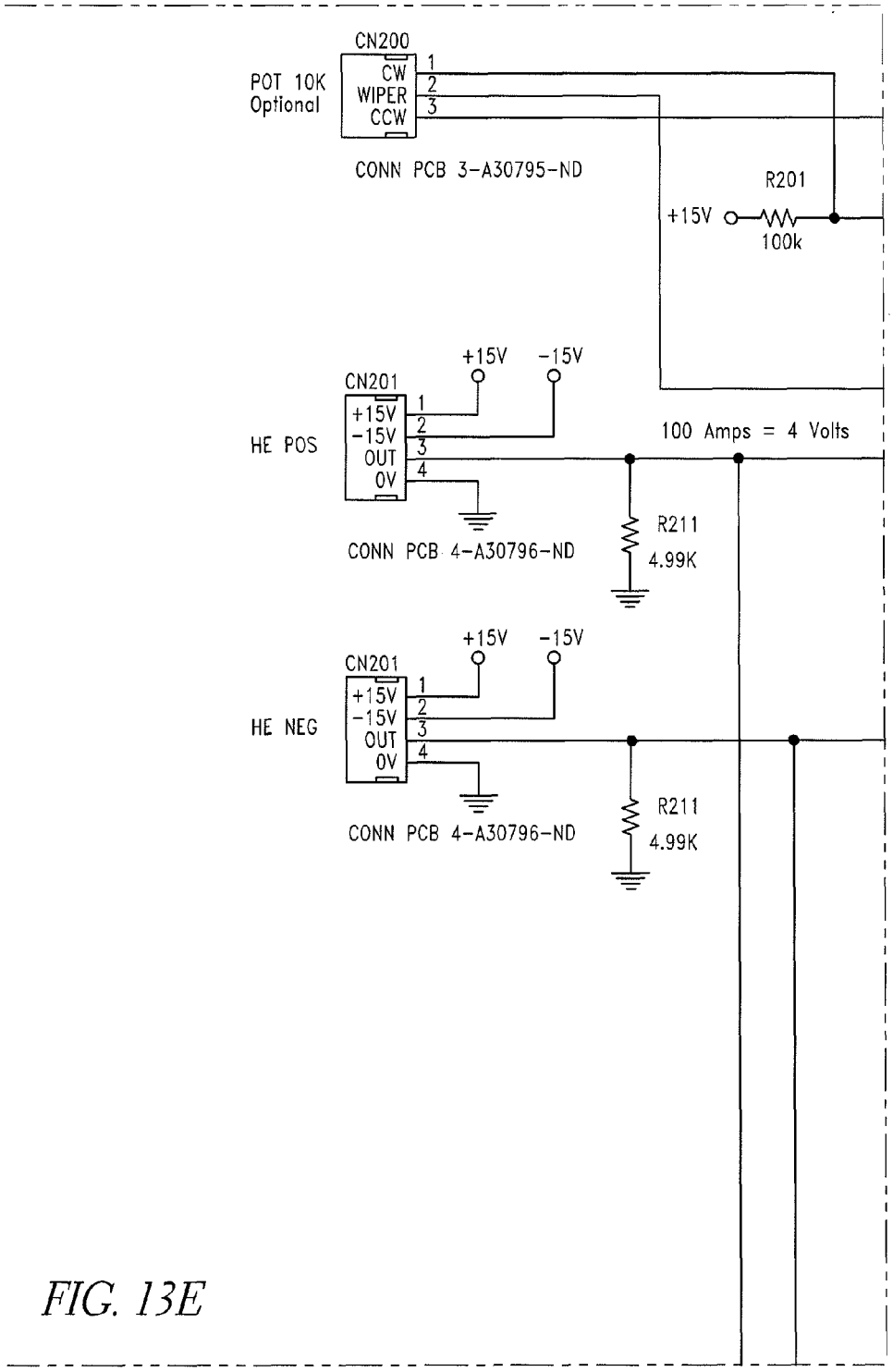
Figure 13F:
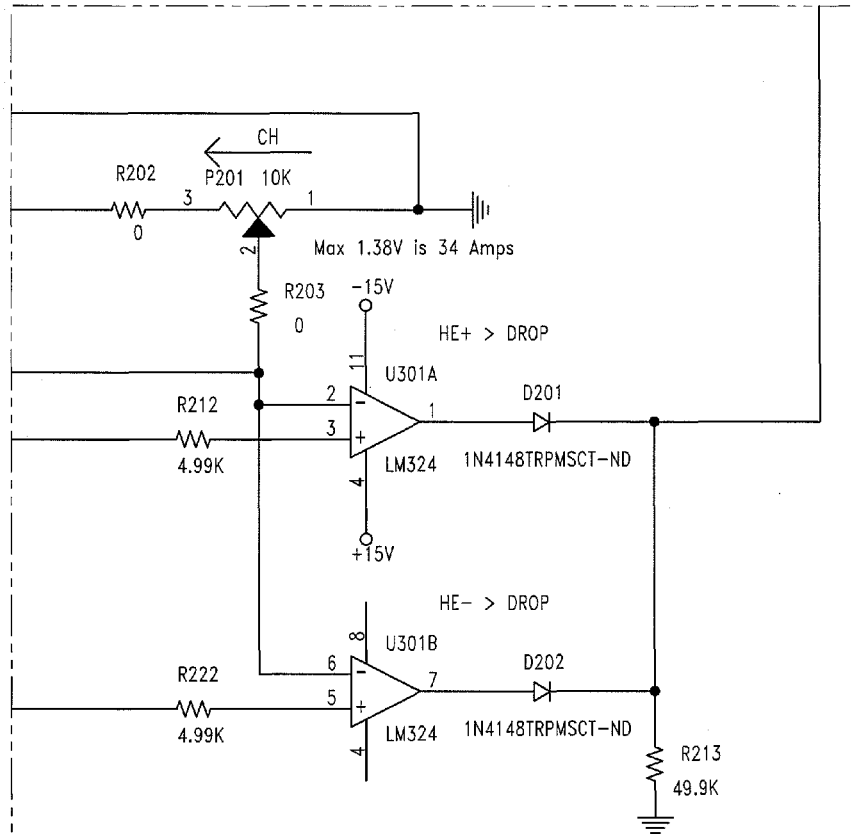
Figure 13G:
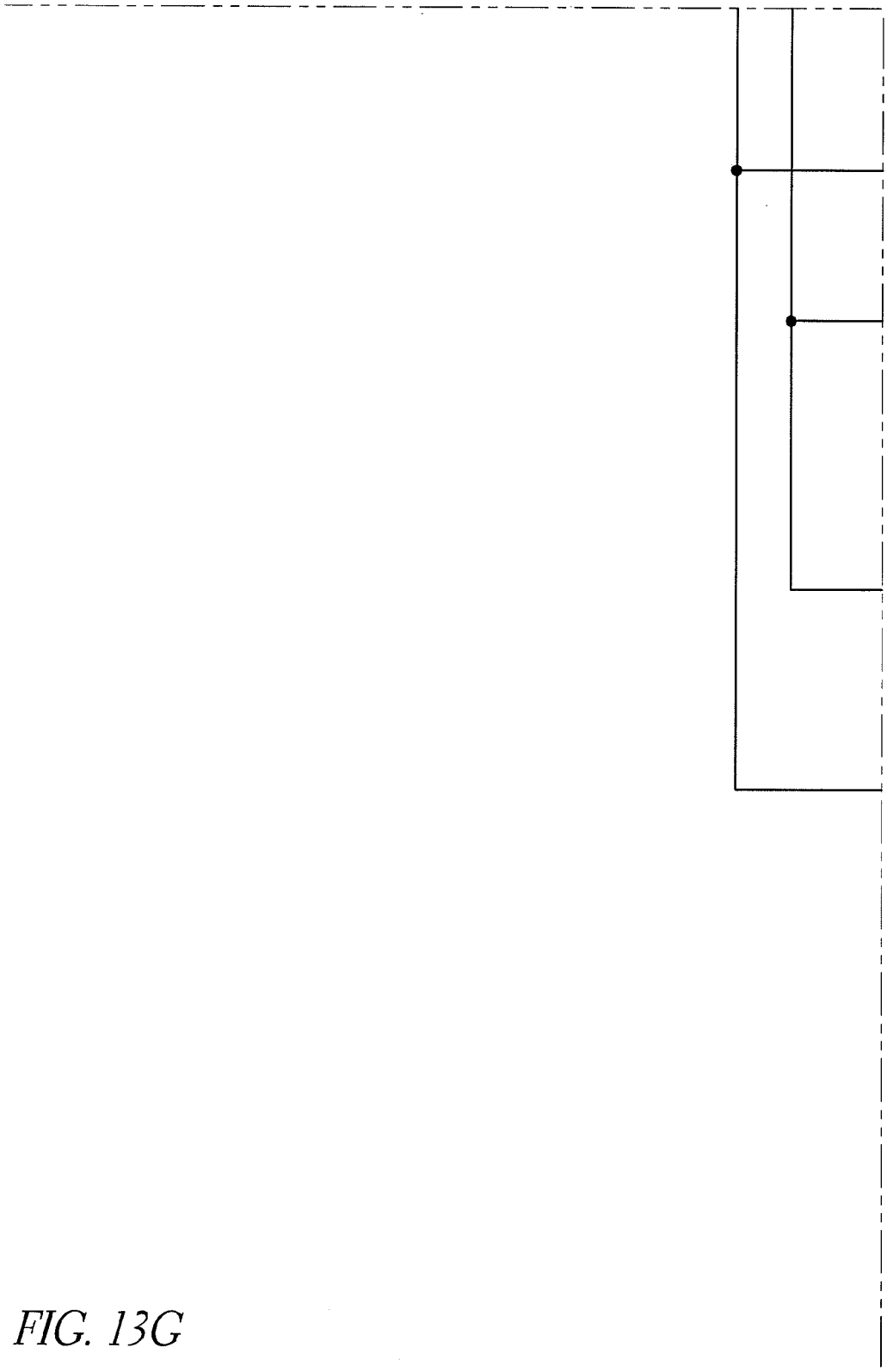
Figure 13H:
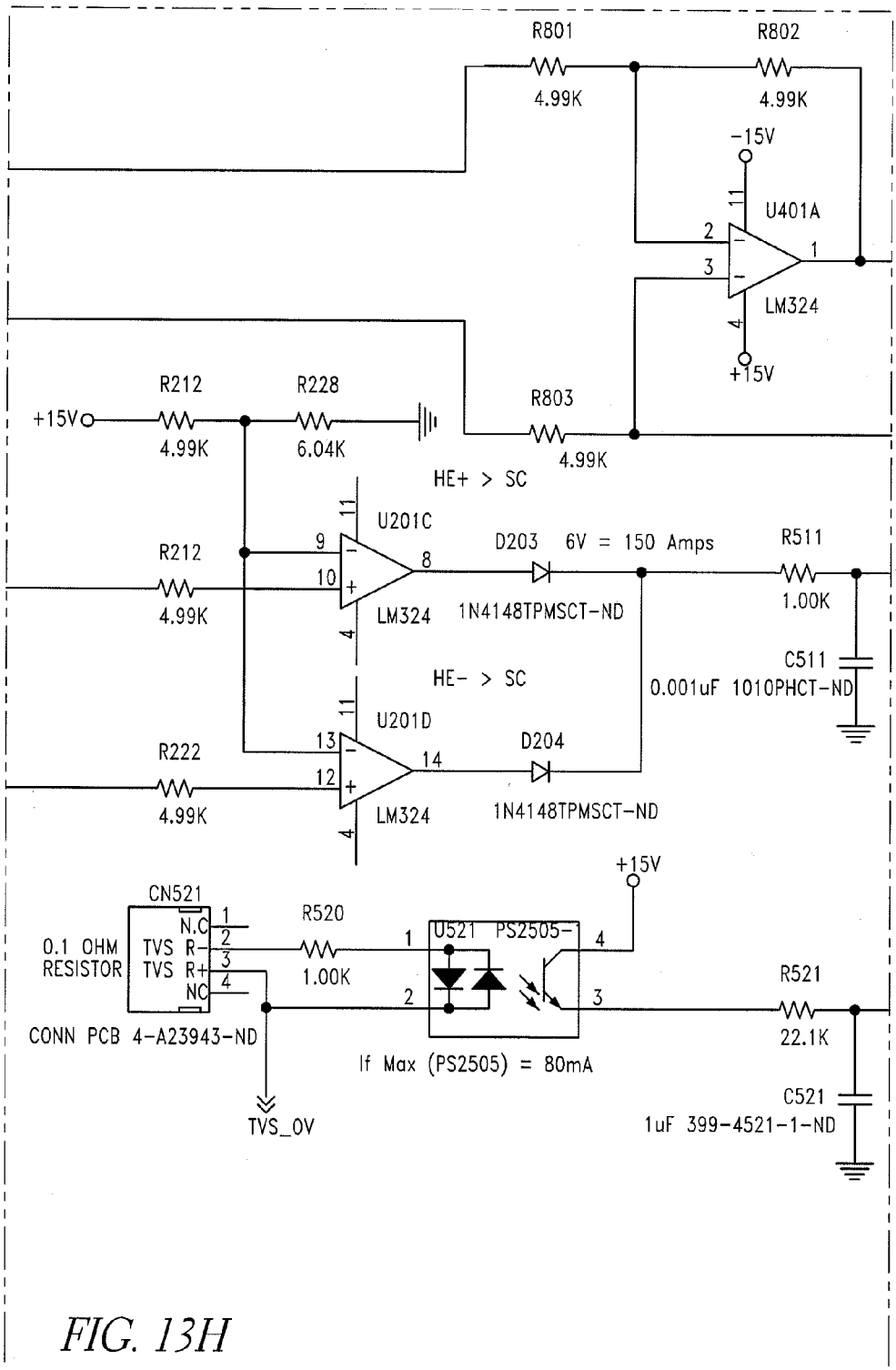
Figure 13I:
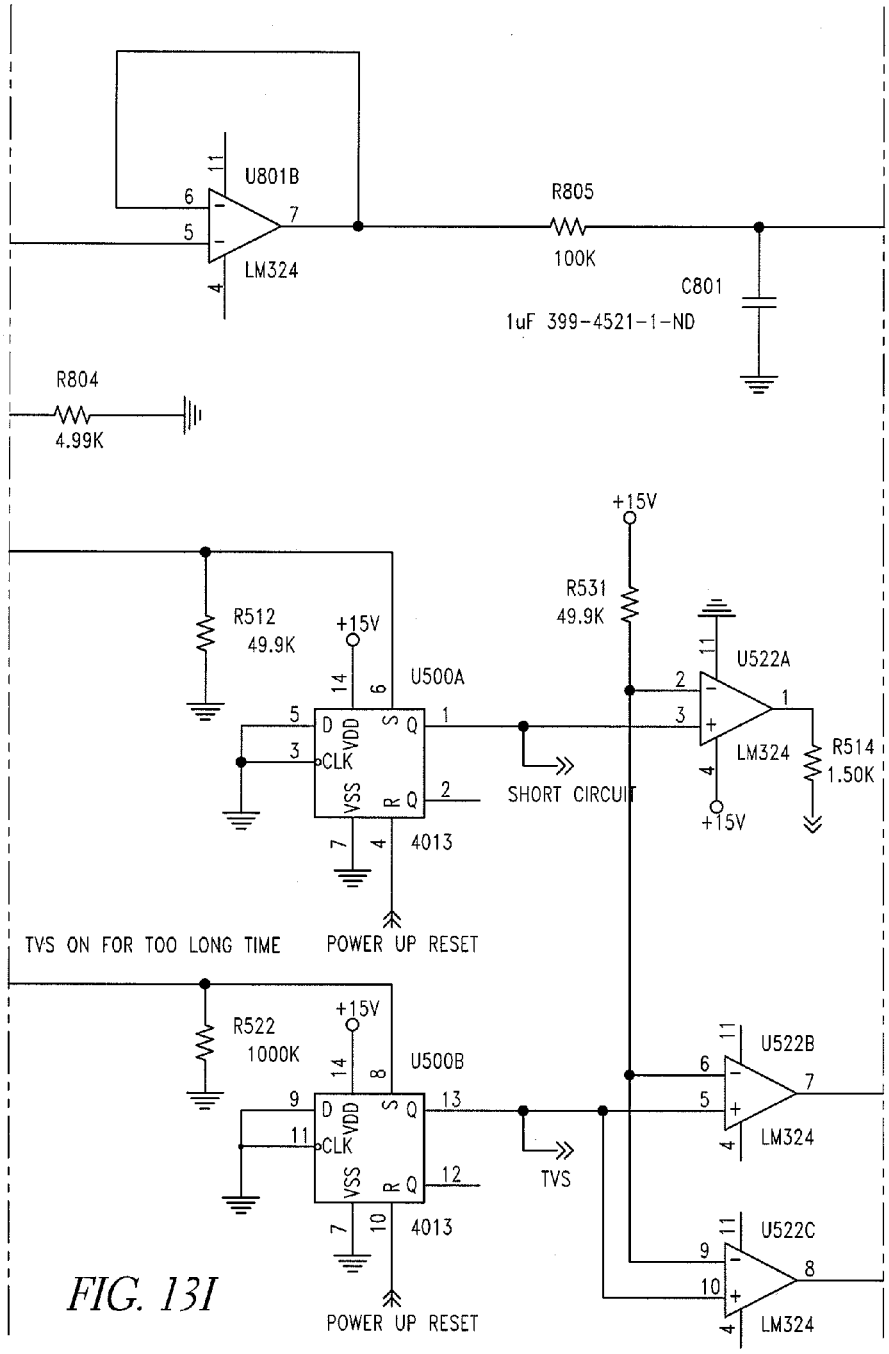
Figure 13J:
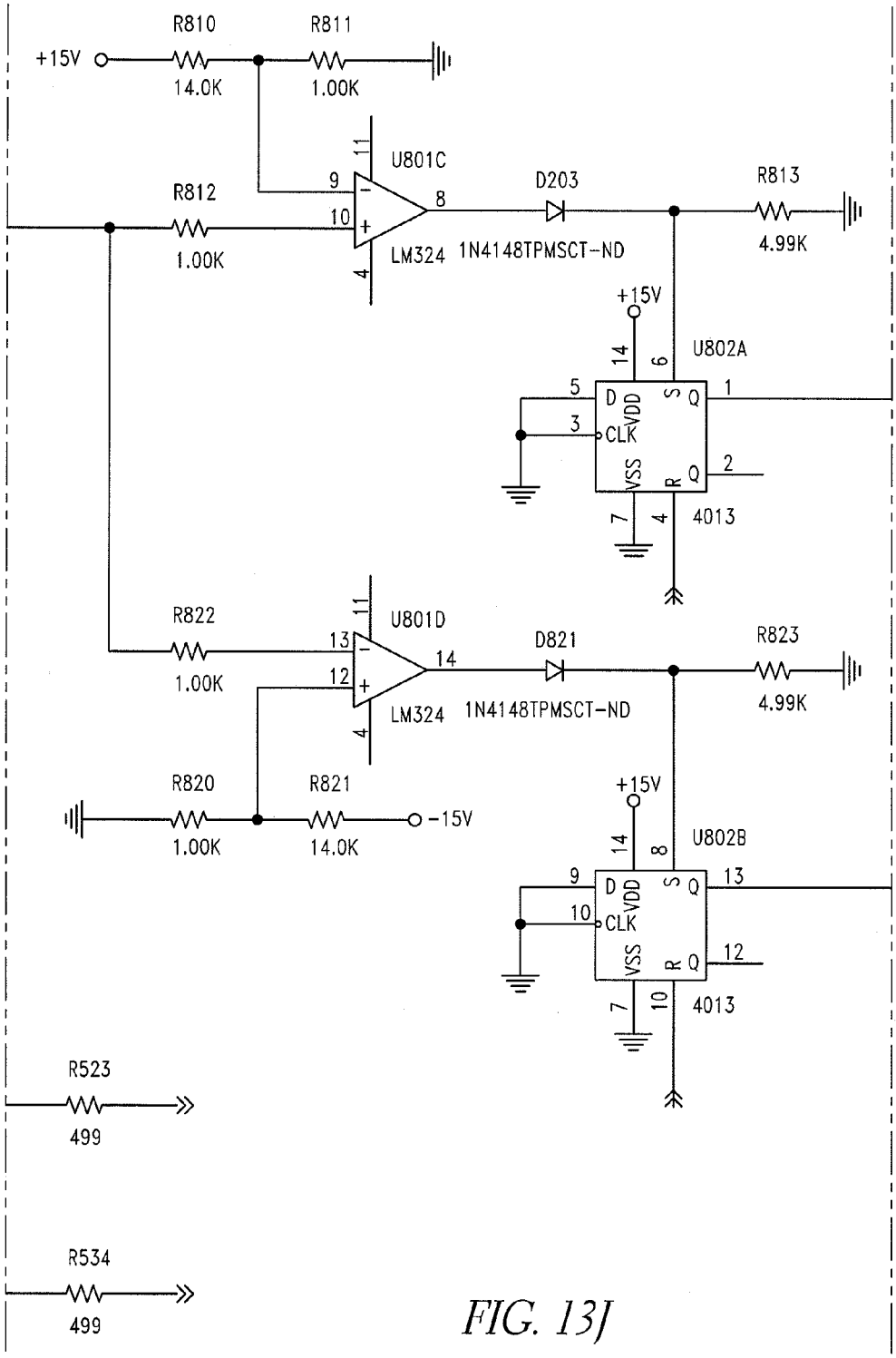
Figure 13K:
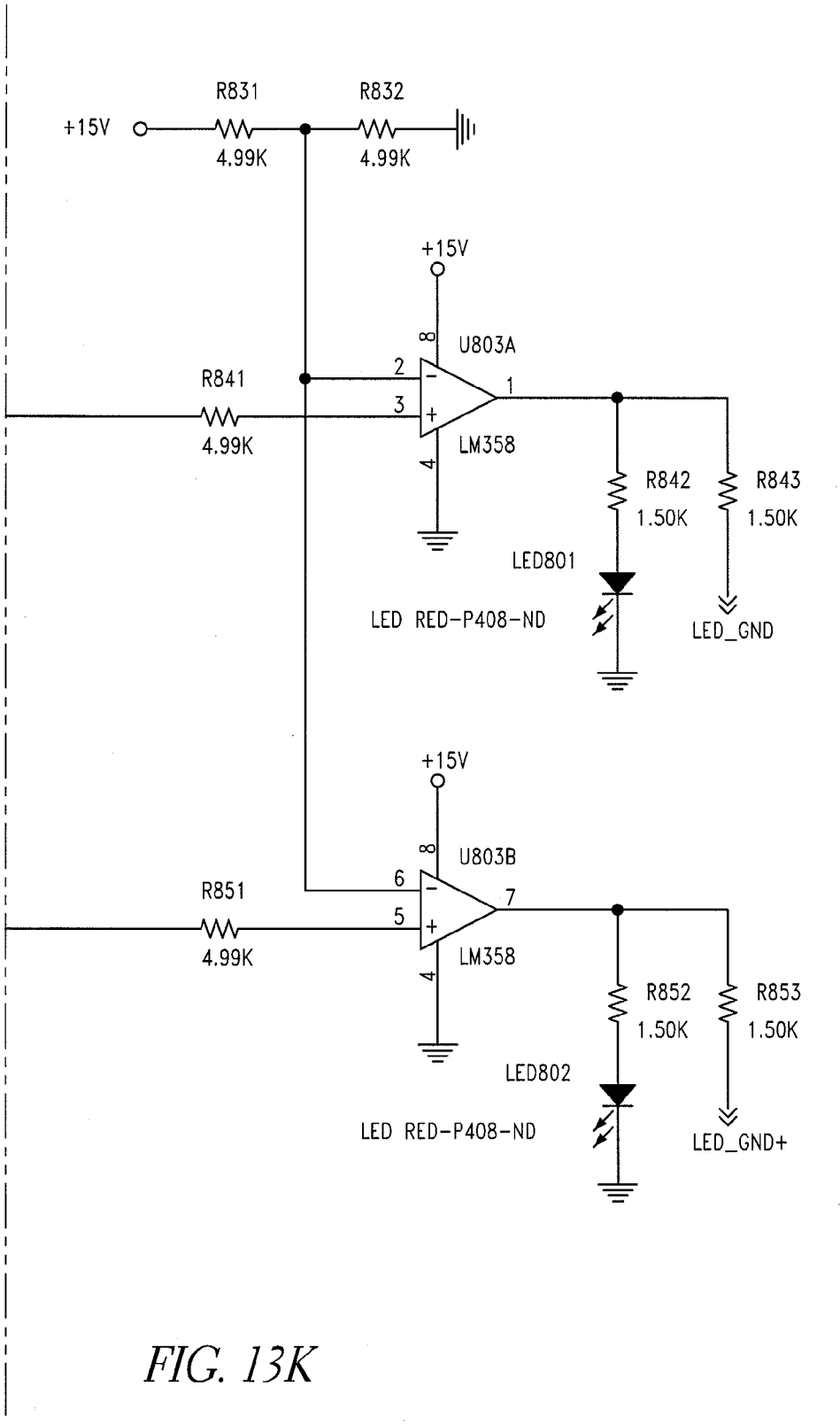

FIG. 13B shows "LIFT" and "DROP" outputs. The "LIFT" output is provided to drivers that control the switches 102 and

103. The "DROP" output is provided to drivers that control the switches 101 and 104. The "LIFT" output is activated to produce the lift function. The "DROP" output is activated to control the drop function.

It will be evident to those skilled in the art that the invention is not limited to the details of the foregoing illustrated embodiments and that the present invention may be embodied in other specific forms without departing from the spirit or essential attributed thereof; furthermore, various omissions, substitutions and changes may be made without departing from the spirit of the inventions. The foregoing description of the embodiments is, therefore, to be considered in all respects as illustrative and not restrictive, with the scope of the invention being delineated by the appended claims and their equivalents.

What is claimed is:

1. A control system for a lifting magnet, comprising:

a positive current input;

a negative current input;

a first current sensor configured to measure current provided to the positive current input;

a bridge circuit comprising a plurality of switches;

a transient voltage suppressor provided to the bridge, wherein the transient voltage suppressor is connected in parallel with said bridge circuit;

a first output for providing current to an electromagnet;

a second output for providing current to the electromagnet; and a logic controller configured to control the plurality of switches such that current flows from the positive current input to the first output of the electromagnet, the logic controller further configured to control the plurality of switches such that current flows through the transient voltage suppressor, the logic controller further configured to control the plurality of switches such that current flows from the positive current input to the second output of the electromagnet.

2. The control system of claim 1 wherein the logic controller is further configured to maintain said drop current loop until a desired drop current is detected by said first current sensor.

3. The control system of claim 2, wherein said logic controller is further configured to provide a current loop comprising said second output terminal, said first output terminal, said first flyback diode said transient voltage suppressor and said fourth flyback diode when an open circuit occurs between said first current input and said second current input during lift.

4. The control system of claim 3, wherein said logic controller is further configured to protect said transient voltage suppressor from excess current by closing said third switch when current in said transient voltage suppressor exceeds a specified current when an open circuit occurs during lift.

5. The control system of claim 4 further comprising a third current sensor configured to sense current in said transient voltage suppressor.

6. The control system of claim 5, wherein said third current sensor comprises a resistor.

7. The control system of claim 5, wherein said third current sensor comprises a Hall-effect sensor.

8. The control system of claim 5, wherein said third current sensor comprises a current shunt.

9. The control system of claim 5, wherein said third current sensor comprises a current transformer.

10. The control system of claim 2, wherein said controller is further configured to provide a current loop comprising said second output terminal, said third flyback diode said transient voltage suppressor and said second flyback diode, and said first output terminal when an open circuit occurs between said first current input and said second current input during drop.

11. The control system of claim 2, wherein said controller is further configured to protect said transient voltage suppressor from excess current by closing said first switch when current in said transient voltage suppressor exceeds a specified current when an open circuit occurs during drop.

12. The control system of claim 3, wherein said logic controller is further configured to protect said transient voltage suppressor from excess current by closing said second switch when current in said transient voltage suppressor exceeds a specified current when an open circuit occurs during lift.

13. The control system of claim 10, wherein said logic controller is further configured to protect said transient voltage suppressor from excess current by closing said fourth switch and said second switch when current in said transient voltage suppressor exceeds a specified current when an open circuit occurs during drop.

14. The control system of claim 2 further comprising a second current sensor configured to sense current provided to said negative current input.

15. The control system of claim 14, wherein said second current sensor comprises a resistor.

16. The control system of claim 14, wherein said second current sensor comprises a Hall-effect sensor.

17. The control system of claim 14, wherein said second current sensor comprises a current shunt.

18. The control system of claim 14, wherein said second current sensor comprises a current transformer.

19. The control system of claim 2, wherein said first switch comprises a solid-state switch.

20. The control system of claim 2, wherein said first switch comprises a transistor.

21. The control system of claim 2, wherein said first switch comprises an insulated gate bipolar transistor.

22. The control system of claim 2, wherein said first switch comprises a MOSFET.

* * * * *